US007412851B2

(12) United States Patent
Lonati

(10) Patent No.: US 7,412,851 B2
(45) Date of Patent: Aug. 19, 2008

(54) DEVICE TO IMPROVE THE YARN THREADING OF THE THREAD GUIDES FOR WARP LINEAR KNITTING MACHINES

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 47 days.

(21) Appl. No.: 11/740,665

(22) Filed: Apr. 26, 2007

(65) Prior Publication Data

US 2007/0251277 A1 Nov. 1, 2007

(30) Foreign Application Priority Data

Apr. 28, 2006 (IT) ..... BS2006A0089

(51) Int. Cl.
*D04B 27/02* (2006.01)

(52) U.S. Cl. ..... 66/203

(58) Field of Classification Search ..... 66/203, 66/204, 205, 206, 207, 208
See application file for complete search history.

(56) References Cited

U.S. PATENT DOCUMENTS 2,533,061 A 12/1950 Sorton
2,733,583 A * 2/1956 Porter ..... 66/204
2,786,344 A * 3/1957 Lambach et al. ..... 66/207
2,921,453 A * 1/1960 Noe ..... 66/207
6,289,703 B1 * 9/2001 Kress et al. ..... 66/207

FOREIGN PATENT DOCUMENTS

DE 197 81 593 B4 11/2006
WO WO 98/26120 A1 6/1998

* cited by examiner

*Primary Examiner*—Danny Worrell
(74) *Attorney, Agent, or Firm*—Pearne & Gordon LLP

(57) ABSTRACT

A device (1) for improving the threading of thread-guides (5) for warp linear knitting machines (10), comprising at least a first support (6) that is associated or coupled to a supporting structure (11) of a warp linear knitting machine (10), a second support (7) operatively placed between the first support (6) and the supporting structure (11), a plurality of thread-guides (5) designed to guide threads while knitting a knitted item, and at least one thread-guide (5) bar (2) operatively associated or coupled to the first support (6) to which the thread-guides (5) are associated or coupled. The first (6) and the second (7) support are movable with respect to the supporting structure (11) between an operating position, in which the thread-guides (5) are active for the formation of the knitting item, and at least one threading position, angularly rotated with respect to the operating position, in which the threading of the thread-guides (5) takes place.

27 Claims, 7 Drawing Sheets

Fig. 2A
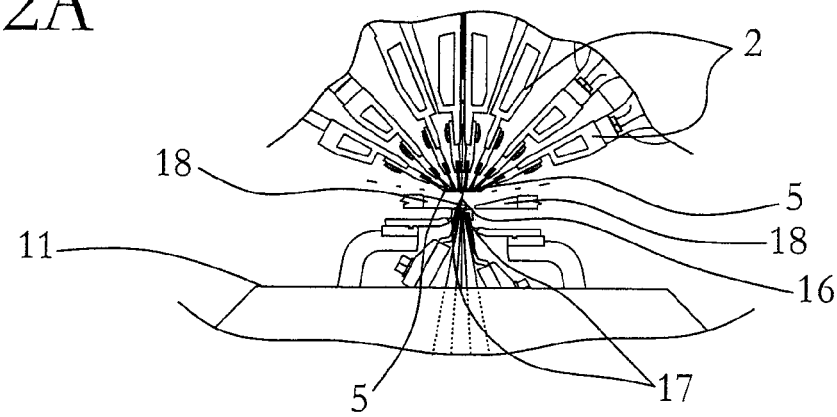
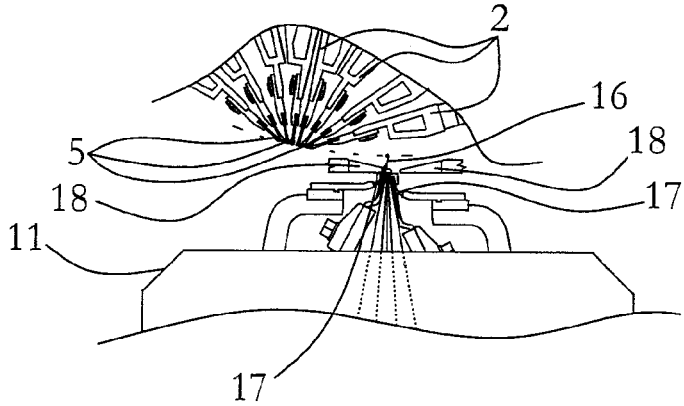
Fig. 3A
Fig. 4A
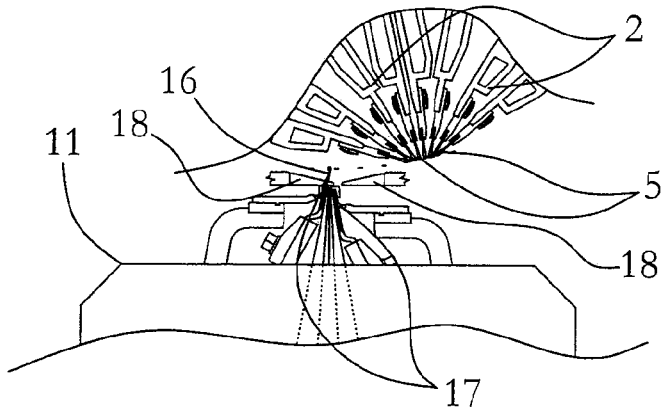

DEVICE TO IMPROVE THE YARN THREADING OF THE THREAD GUIDES FOR WARP LINEAR KNITTING MACHINES

FIELD OF THE INVENTION

The present invention relates to a device for improving the threading of thread-guides for warp linear knitting machines, also known as Raschel-type warp looms, with double or single needlebed.

BACKGROUND OF THE INVENTION

Generally speaking, Raschel-type warp looms with double or single needlebed are multibar, i.e. they comprise a plurality of thread-guide bars, from a minimum of two to eight and more, placed one beside the other so as to be basically parallel to one another.

As is known, each bar is associated to a plurality of thread-guides whose function is to guide threads during the knitting process. As a rule, each bar is associated to a number of thread-guides corresponding to the number of needles of a single needlebed. For instance, in a knitting machine with a needlebed of about 3.5 meters and a fineness of 24 (i.e. 24 needles pro inch of length), each bar can carry 3,312 thread-guides.

In order to perform their function, the thread-guides have to be threaded with the threads taking part in the knitting process. The threading of each thread-guide depends on the kind of fabric to be obtained. It should be pointed out that not all thread-guides are threaded simultaneously; generally, half of them are threaded, i.e. one or two thread-guide bars of the machine have full threading and the other variable threading.

The threading of the thread-guides is carried out only by hand by the personnel working in the knitwear factory, depending on the technical specifications required by the knitted item.

Threading is an extremely critical and difficult operation due to the large number of thread-guides to be threaded and since the useful space between two adjacent thread-guides is very narrow (less than one millimeter in case of fineness 24). For instance, fully threading a machine equipped with eight thread-guide bars can require a time of about 3 hours for 4 operators working simultaneously.

As is known, in order to facilitate threading combs are used having a plurality of teeth embedded into a lead block and ending up into a hook so as to thread simultaneously more thread-guides, as a rule ten to twenty. Each tooth is led through the eyelet of the thread-guide to be threaded, so as to intercept by means of the hook a thread and introduce it into the eyelet of the thread-guide.

The use of such threading combs enables to make the thread-guide threading process faster but requires that only one clean thread-guide bar gets before the operator. As a consequence, in order to carry out this operation, as a rule the outer bars are dismounted temporarily and threading starts from the inner ones.

This involves an increase of time and costs for dismounting the bars, subsequently re-mounting them and, if necessary, re-calibrating the machine. Moreover, there are still significant problems in case of thread breaks during the knitting step, since the thread has to be threaded again with the bars mounted, thus in a small operating space and trying not to damage the fabric. These drawbacks have been partially solved by known devices, such as the one described in document U.S. Pat. No. 6,289,703, involving the vertical lifting of the thread-guide bars, of the support thereof and of the oscillating shaft, around which said support moves with an oscillating motion for carrying out the "swing" movement and bringing alternatively the threads before and behind the needle hook. The accessibility of the thread-guides is thus improved, especially of those associated to the inner bars, and therefore threading does not require operations involving the temporary dismounting of the outer bars.

However, also these solutions are not without drawbacks. First of all, the structure of the machine becomes very solid and bulky due to the large size of the mechanisms designed to lift the devices dedicated to the "swing" movement since the masses to be lifted are quite high. The lifting of the mechanisms performing the "swing" movement further involves modifications of the anchoring positions of said mechanisms and, therefore, there are inevitably clearances affecting the accuracy of the machine and increasing vibrations, which are already quite difficult to control in case of supports and oscillating shafts firmly anchored to the machine.

As a consequence, the machine becomes more expensive, complicated and difficult to manage and handle.

Moreover, the lifting of the mechanisms dedicated to the "swing" movement is quite small, generally around 10-20 mm, i.e. enough to give a minimum access to the thread-guides of the innermost bars. As a consequence, there is still the problem of the full accessibility and visibility of the inner thread-guides, which, although being lifted with respect to the needles, are parallel to the latter and in order to carry out threading the operators have to work in an uncomfortable and little safe position, since they have to physically lower their heads under the plane of the needles so as to be able to see.

BRIEF SUMMARY OF THE INVENTION

An aim of the present invention is to solve the problems of the known technique by proposing a device for improving the threading of thread-guides for warp linear knitting machines without the drawbacks described above. Therefore, an aim of the invention is to show a device for improving the threading of thread-guides for warp linear knitting machines that ensures a good accessibility to the thread-guides enabling to thread such thread-guides in a fast and safe manner, both at the beginning of the knitting process of a given type of knitted items and during the knitting process in case of thread breaks for instance.

A further aim of the invention is to show a device for improving the threading of thread-guides for warp linear knitting machines that ensures a maximum safety for operators carrying out the threading so as to minimize the risk of injuries, especially to extremely important parts of the body such as head, eyes and hands.

Still another aim of the present invention is to propose a knitting machine equipped with devices for improving the threading of thread-guides that has a slim structure, that is easy to install in the manufacturing plant, that is simple to manage and involves low costs. Finally, the present invention aims at providing a knitting machine equipped with devices for improving the threading of thread-guides that is accurate, in which clearances and vibrations are small and that enables to manufacture high-quality knitted items.

These and other aims, as will be more apparent in the following description, are achieved according to the present invention by a device for improving the threading of thread-guides for warp linear knitting machines according to the appended claims.

BRIEF DESCRIPTION OF THE DRAWINGS

The following contains, as a merely indicative and non-limiting example, the description of a preferred though not exclusive embodiment of a device for improving the threading of thread-guides for warp linear knitting machines according to the invention, shown in the accompanying drawings, in which:

FIG. 2A shows a first magnified detail of FIG. 2;

FIG. 3A shows a magnified detail of FIG. 3;

FIG. 4A shows a magnified detail of FIG. 4;

DETAILED DESCRIPTION OF THE PREFERRED EMBODIMENTS OF THE INVENTION

With reference to the figures listed above, a device for improving the threading of thread-guides is referred to as a whole in the accompanying drawings with numeral 1. Such devices 1 can apply to warp linear knitting machines 10, also known as Raschel-type warp looms, with single or double needlebed, and being preferably multibar.

Figure 5:
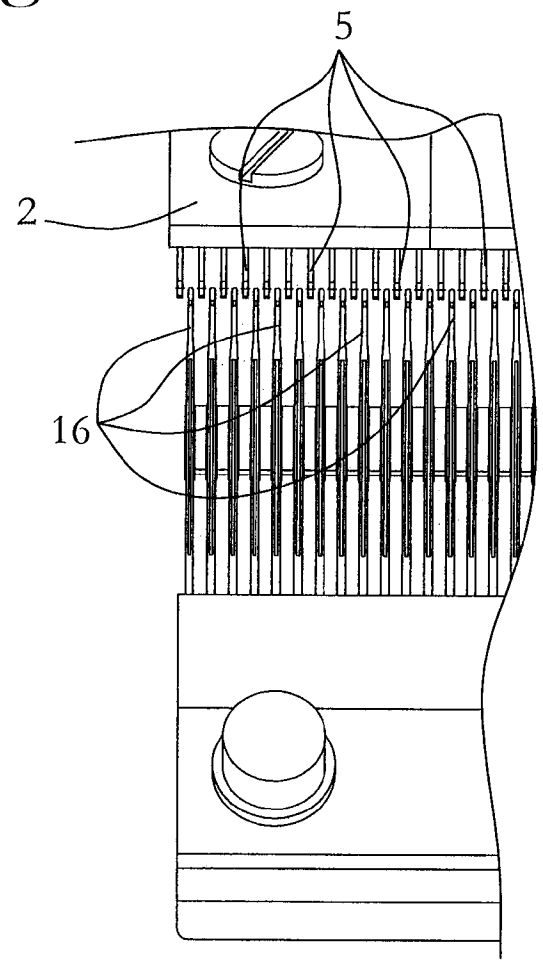
FIG. 5 shows a first magnified detail of FIG. 1.

A device 1 for improving the threading of thread-guides 5 according to the invention comprises at least a first support 6 that can be associated to the supporting structure 11 of a warp linear knitting machine 10, a plurality of thread-guides 5 designed to guide threads while knitting a knitted item, and at least one thread—guide bar 2 operatively associated to the first support 6 to which the thread-guides 6 are associated. As can be seen on FIGS. 2A and 5, the thread-guides 5 are designed to cooperate actively with the other knitting elements, such as needles 16, latches 17 (tongues) and holding-down elements 18 (stitch-combs) for manufacturing the knitted items.

Figure 1:
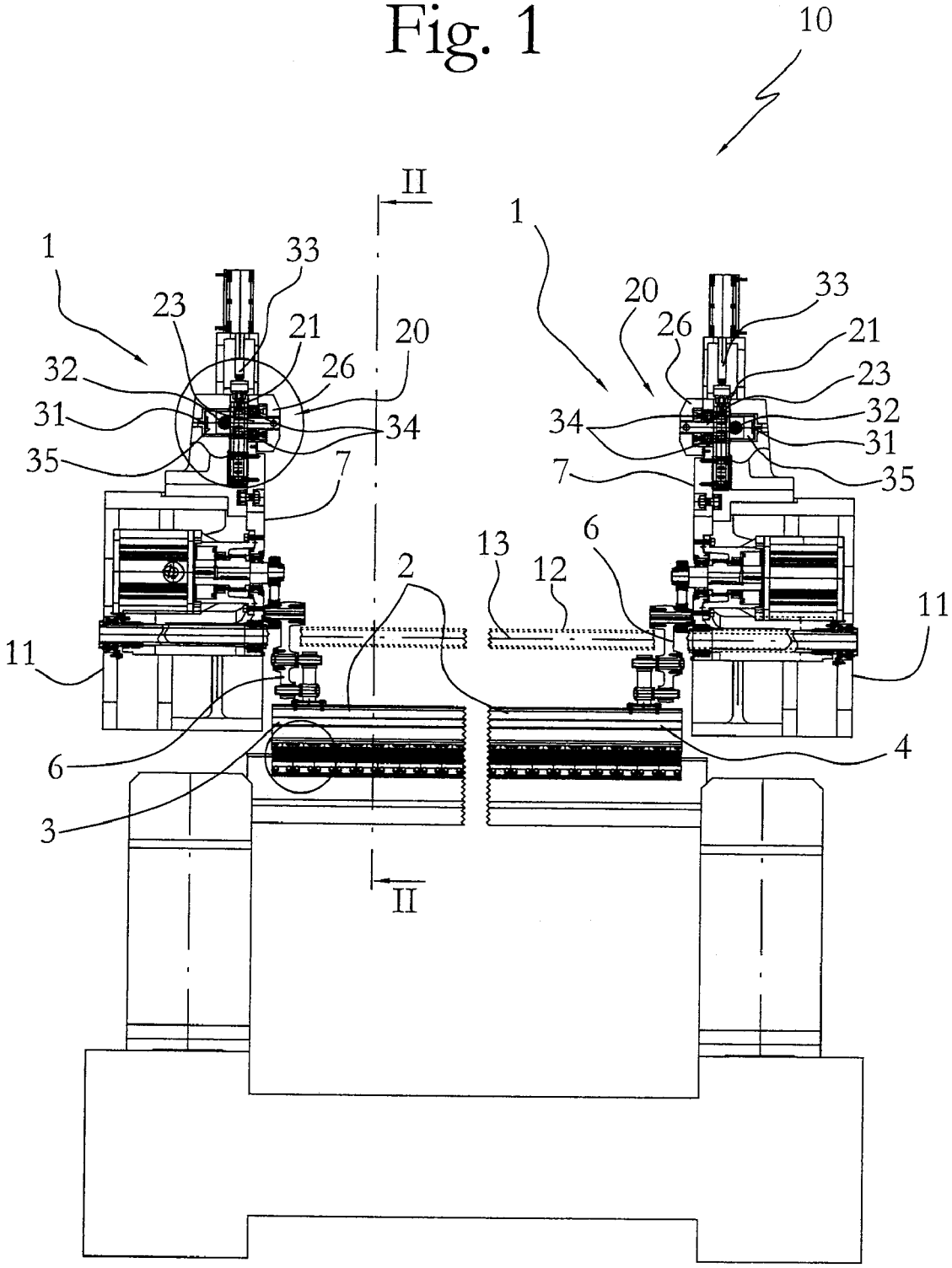
FIG. 1 shows a front view of a warp linear knitting machine equipped with devices for improving the threading of thread-guides according to the invention.
Figure 2:
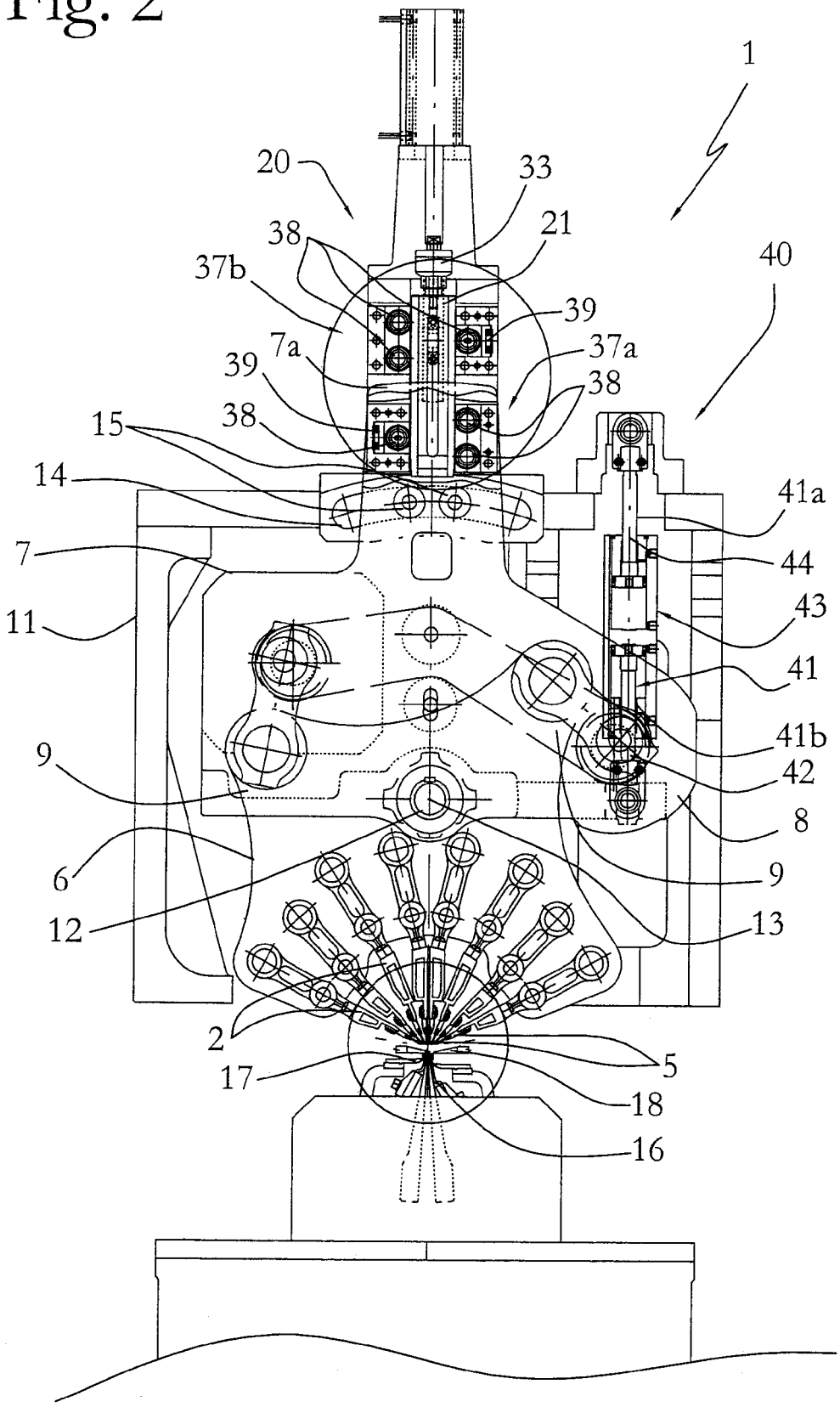
FIG. 2 shows a section of FIG. 1 according to lines II-II, in which the first and second support are in operating position.
Figure 4:
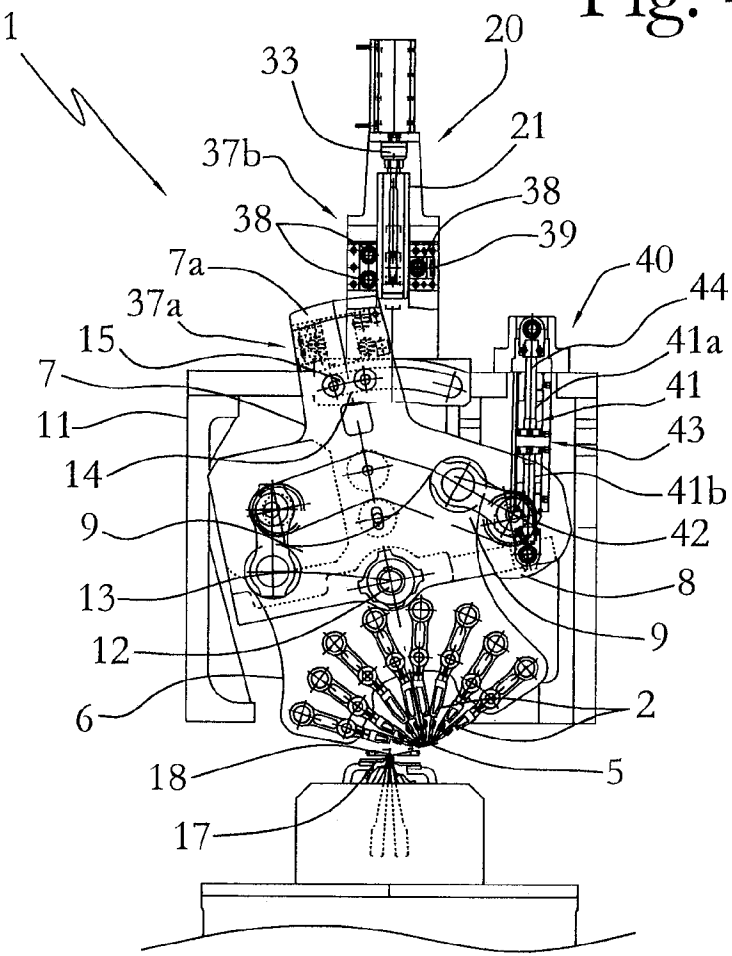
FIG. 4 shows a section of FIG. 1 according to lines II-II, in which the first and second support are in a second threading position.
Figure 3:
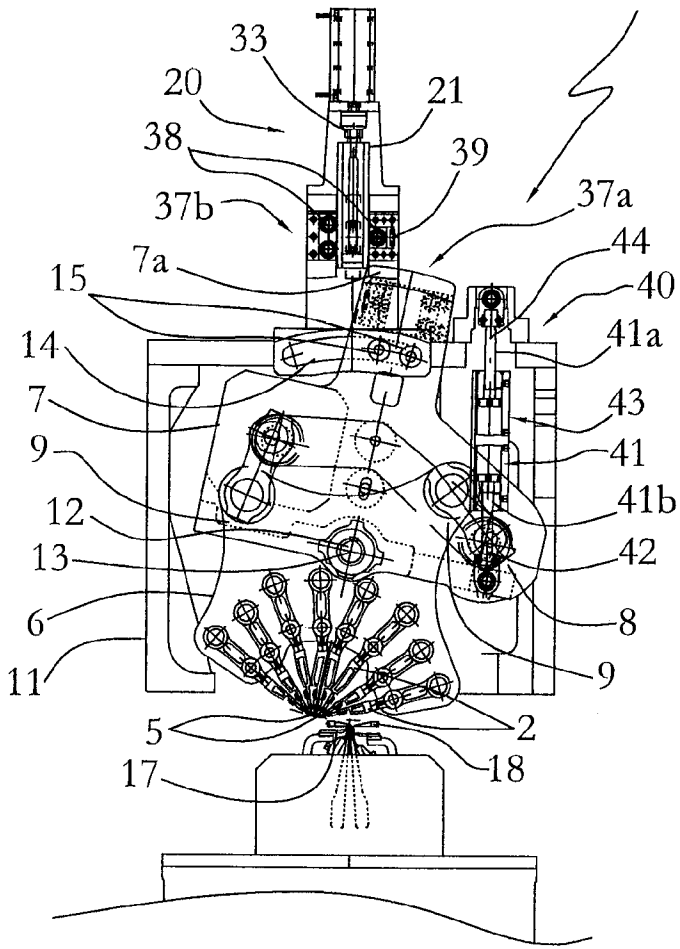
FIG. 3 shows a section of FIG. 1 according to lines II-II, in which the first and second support are in a first threading position.

The device 1 is characterized in that the first support 6 is movable with respect to the supporting structure 11 between an operating position, in which the thread-guides 5 are active for the formation of the knitted item, and at least one threading position, angularly rotated with respect to said operating position, in which the thread-guides 5 are threaded (FIGS. 2, 3 and 4). Thus the thread-guides 5 are led outside the knitting area to an area of the machine 10 that is accessible and not dangerous, and their opening points towards the operator and is no longer in vertical position (FIGS. 3A and 4A).

In a preferred embodiment of the invention, the device 1 also comprises a second support 7 operatively placed between the supporting structure 11 and the first support 6 and moving between the operating and threading positions integrally with the first support 6.

Advantageously, as can be seen on FIG. 2, the device 1 further comprises an oscillating shaft 12 having a main axis 13 around which the first 6 and the second 7 support rotate when moving between the operating position and the threading position.

According to the invention, in order to optimize the accessibility of the thread-guides 5, independently from the bars 2 to which they are associated, the first 6 and the second 7 support are movable between an operating position and two threading positions, one rotated clockwise with respect to the operating position and one counterclockwise.

It should be pointed out that in the operating position the first support 6 is movable with respect to the second one 7 with an oscillating motion around the main axis 13 of the oscillating shaft 12 for moving the thread-guides 5 transversally to the hook of the needles 16, in order to carry out the movement commonly known as "swing", so as to ensure a correct feeding of the threads onto the needles 16. The oscillating motion of the first support 6 with respect to the second one 7 around the main axis 13 of the oscillating shaft 12 for the "swing" movement is less broad than the integral movement of the two supports 6, 7 with respect to the supporting structure 11, still around the main axis 13, for the passage between the operating position and the threading positions.

It should be pointed out that the mechanisms enabling the first support 6 to move with an oscillating motion with respect to the second one 7 for the "swing" movement are associated to the supporting structure 11 of the machine 10.

In particular, the first support 6 is associated to the second one 7 on at least one first mounting point 9. Preferably, the first support 6 is associated to the second one 7 on two distinct mounting points 9 opposed with respect to a vertical plane containing the main axis 13 of the oscillating shaft 12, so as to move the first support 6 with an oscillating motion in a balanced way with respect to the main axis 13 (FIGS. 2, 3 and 4).

Still according to the invention, the device 1 further comprises blocking means or blocker 20 designed to block the second support 7 and prevent the rotation thereof with respect to the supporting structure 11 so as to let it stay in the operating position, and to release it and enable the movement thereof from the operating position to the threading positions. In this case the second support 7, in its movement from the operating position to the threading positions, drags with it integrally during the rotation of the shaft 12, and therefore around the main axis 13, the first support 6.

Advantageously, the blocking means 20 comprise a bolt 21 that is movable with respect to the supporting structure 11 according to a basically vertical direction perpendicular to the main axis 13 of the oscillating shaft 12 between a lowered position and a lifted position, and an engagement element 22 operatively associated to said bolt 21 so as to move longitudinally between an active position, when the bolt 21 is in lowered position, in which it acts operatively upon the second support 7 so as to block it in rotation with respect to the supporting structure 11, and a passive position, when the bolt 21 is in lifted position, in which it is led away from the second support 7 so as to enable the rotation thereof for the passage from the operating position to the threading positions.

In further detail, the engagement element 22 comprises a rod 23 developing according to a longitudinal direction basically perpendicular to the direction of movement of the bolt 21, and a bracket 26 fitted onto a first end 24 of the rod 23, designed, when the engagement element 22 is in active position, to exert a pushing action onto the second support 7 that is basically perpendicular to said second support 7, so as to prevent the rotation thereof with respect to the supporting structure 11.

The bolt 21 further has—advantageously—a cam profile 27 to which the rod 23 is operatively associated on a second end 25 thereof, and the blocking means 20 comprise a pushing element 31 acting upon the second end 25 of the rod 23 so as to push it against the cam profile 27 so as to move the rod 23 and the bracket 26 between the passive and the active position. The blocking means 20 also comprise a first bearing 32 moving longitudinally according to the direction of movement of the rod 23 and firmly fitted onto said rod 23 on the second end 25 thereof, and as a result the pushing element 31 acts upon the rod 23 by means of said first bearing 32 and said rod 23 is operatively associated to the cam profile 27 still by means of the first bearing 32.

Preferably, the pushing element 31 consists of Belleville washers acting upon the first bearing 32 by means of a support 25 sliding longitudinally, on which said first bearing 32 is mounted.

Figure 6B:
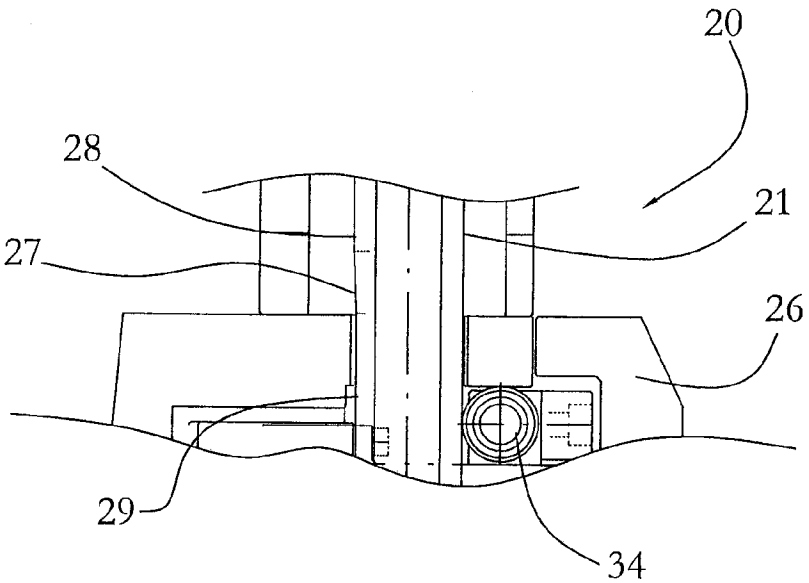
FIG. 6B shows a magnified detail of FIG. 6A.
Figure 7:
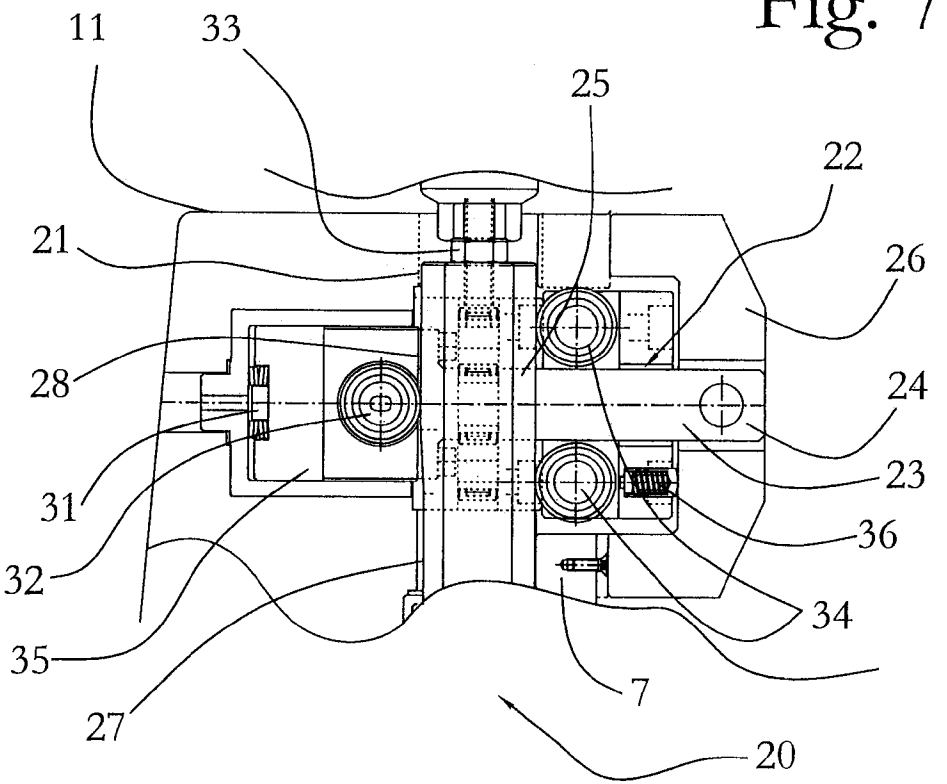
FIG. 7 shows a second magnified detail of FIG. 1.
Figure 6A:
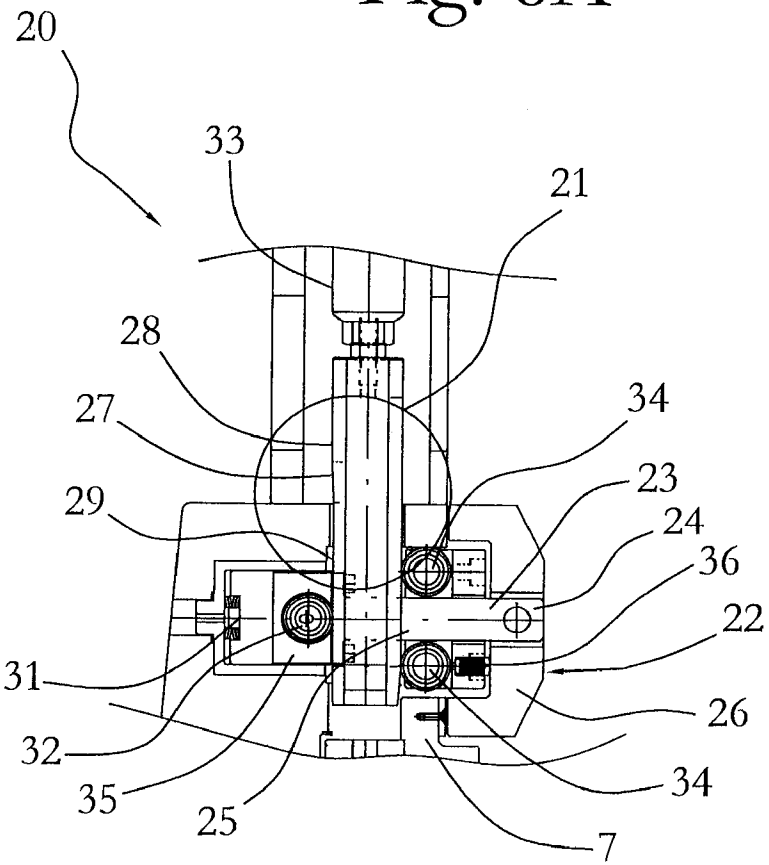
FIG. 6A shows a magnified detail of FIG. 6.
Figure 6:
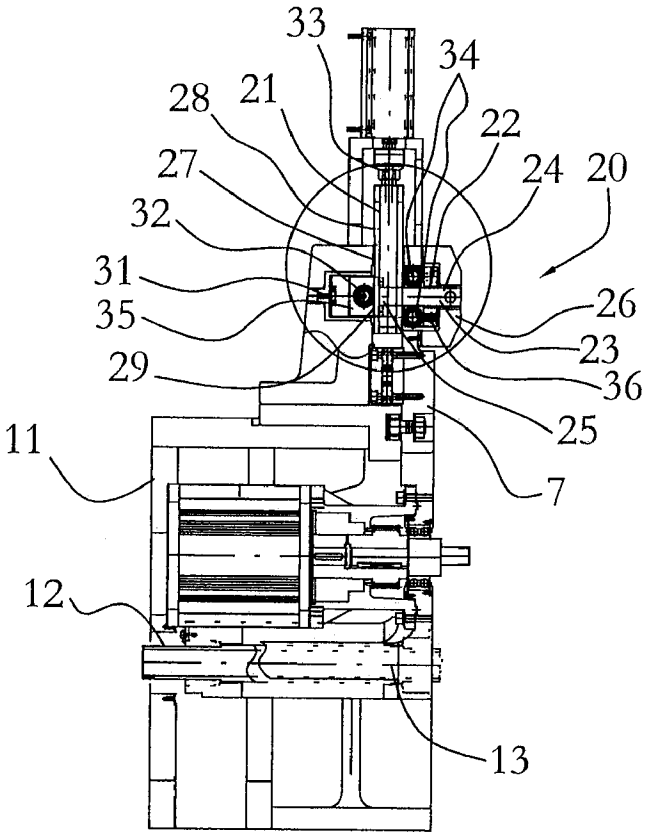
FIG. 6 shows a schematic front view of a device for improving the threading of thread-guides for warp linear knitting machines according to the invention.

As can be seen in particular on FIG. 6B, the cam profile 27 is tapered down at least on one side, having at least a first portion 28 and a second portion 29, which is longitudinally concave with respect to the first one 28, as is shown in FIGS. 6A and 7. Thus, when the bolt 21 is in lowered position, the first bearing 32 is in contact with the first portion 28 of the cam profile 27 so that the rod 23 in active position is pulled back longitudinally for blocking the rotation of the second support 7 with respect to the supporting structure 11. Conversely, when the bolt 21 is in lifted position, the first bearing 32 is in contact with the second portion 29 of the cam profile 27 so that the rod 23 in passive position is pushed forward longitudinally for releasing the second support 7 in rotation with respect to the supporting structure 11. In other words, the cam profile 27 placed on the left side of the bolt 21, when the latter is in lowered position, makes the first bearing 32 pull the rod 23 towards itself blocking the second support 7 by means of the bracket 26, whereas, when the bolt 21 is in lifted position, it makes the first bearing 32 move forward so as to release the bracket 26 from the second support 7 by means of the rod 23. Advantageously, a second pushing element 36, as a rule a spring, acts upon the bracket 26, and it is designed to ensure that said bracket 26 is actually released from the second support 7 when the bolt is in lifted position.

The blocking means 20 further comprise an activation element 33 for moving the bolt 21 between the lifted and the lowered positions.

Preferably, the blocking means 20 can comprise at least one second bearing 34 for guiding the bolt 21 in its movement between the lifted position and the lowered one and for cooperating with the pushing element 31 and with the first bearing 32 so as to keep the rod 23 and the bracket 26 stiffly in active position. As can be seen in particular on FIG. 7, there are two second bearings 34 placed one under the other. It should be pointed out that the second bearing 34 is fixed with respect to the supporting structure 11 of the machine 10, since it can only rotate on itself.

Figure 2B:
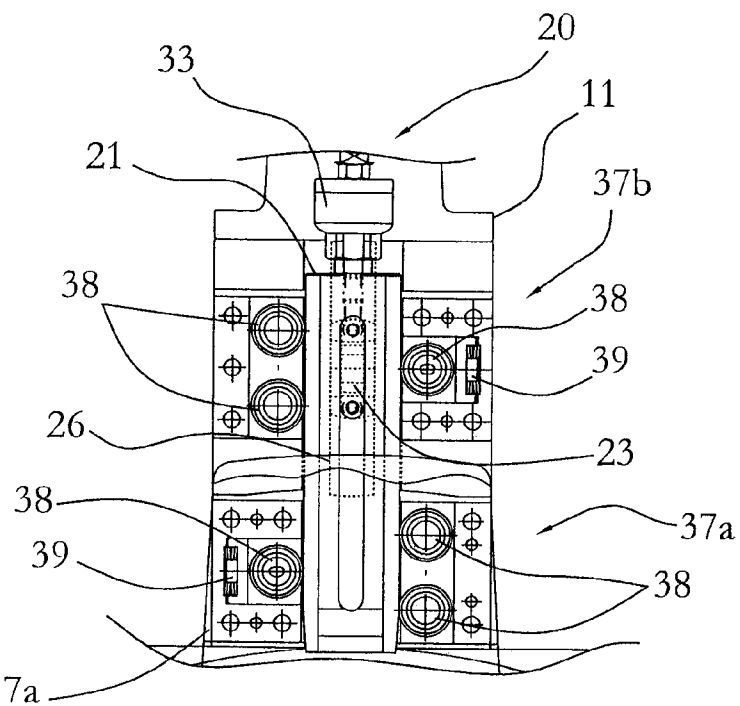
FIG. 2B shows a second magnified detail of FIG. 2.

Eventually, it should be pointed out that the bolt 21, when it is in lowered position, engages with the second support 7 on an upper portion 7*a* thereof. The upper portion 7*a* is associated or counled with first guide means or guide 37*a*, whereas the supporting structure 11 of the machine 10 is associated or coupled, on the bolt 21, to second guide means or guide 37*b*. The first 37*a* and the second 37*b* guide means or guide have the same, though mirrored, structure. Preferably, as can be seen on FIG. 2B, the first guide means or guide 37*a* comprise fourth bearings 38 placed one on the left of the bolt 21, upon which acts a spring 39, preferably a Belleville washer, whose function is to push it against said bolt 21, and two on the right of the bolt 21, which are fixed with respect to translation and oppose the pushing action generated by the Belleville washer 39 by means of the single fourth bearing 38. As was already mentioned, the second guide means or guide 37*b* have the same, though inverted, structure. Therefore, the single fourth bearing 38 is placed on the right whereas the pair of fourth opposing bearings 38 are placed on the left.

The function of the first 37*a* and the second 37*b* guide means is to improve the sliding of the bolt 21, to keep the second support 7 in position, therefore also the first one 6, with respect to the supporting structure 11 of the machine 10 by stiffly fitting the bolt 21 onto said second support 7, and to recover clearances, if present.

Still according to the invention, the device 1 further comprises movement means or mover 40 operatively associated or coupled at least to the second support 7 and designed to move the first 6 and the second support 7 between the operating and threading positions. As is shown in FIGS. 2, 3 and 4, said movement means or mover 40 comprise an actuating element 41 associated to the second support 7 and designed to impart to the two supports 6, 7 a pushing and/or pulling action for moving them between the operating position and the threading positions. In further detail, the actuating element 41 has a basically vertical development perpendicular to the main axis 13 of the oscillating shaft 12 and it is associated by means of a lower end 42 thereof to a lateral portion 8 of the second support 7. At least the lower end 42 of the actuating element 41 is movable and articulated, when the bolt 21 is in lifted position, according to a vertical direction pointing downwards between a rest position in which the first 6 and the second 7 support are in operating position, and a pushing position for pushing the two supports 6, 7 between the operating position and a first threading position or between a second threading position and the operating position (FIG. 3), and according to a vertical direction pointing upwards between the rest position and a pulling position for pulling the two supports 6, 7, between the operating position and the second threading position or between the first threading position and the operating position (FIG. 4).

In the accompanying drawings, the movement means 40 comprise usual pneumatic means. Alternatively, equivalent means can be used, such as for instance ball screw motors or hydraulic means. In the first case, therefore, the movement means 40 comprise a pneumatic piston 43 and the actuating element 41 is a stem of said pneumatic piston 43. In particular, in the execution variant shows, the pneumatic piston 43 has two opposed, physically separated chambers and an upper stem 41*a* and a lower stem 41*b* making up together the actuating element 41. The upper stem 41*a* is hinged to the supporting structure 11 of the machine and is therefore fixed and cannot move along its own axis 44. If air is introduced in the area of the upper stem 41*a*, the lower chamber of the upper stem 41*a* is emptied and the upper chamber of said stem 41*a* is filled up. Since the upper stem 41*a* is fixed, air introduction makes the whole body of the piston 43 move, dragging with it the second support 7 and rotating it as shown on FIG. 4.

Conversely, if the movement means 40 comprise a screw motor, the actuating element is a screw thereof.

Advantageously, the supporting structure 11 comprises a guide 14 having a basically curved shape and the second support 7 comprises at least one third bearing 15 designed to slide inside said guide 14 for guiding the movement of the second support 7 between the operating position and the threading positions.

The device 1 can also include a system for recovering threads that got lengthened during the threading operation (not shown).

According to the invention, the device 1 disclosed in the variant shown on the accompanying figures works as follows:

In operating position the first 6 and the second 7 support are basically vertical and the first support 6 oscillates with respect to the second one 7, around the oscillating shaft 12, so as to carry out the movement known as "swing" required for correctly feeding the threads onto the needles 16. Under these circumstances, the bolt 21 is in lowered position and the second bearings 34 are loaded with a strong pressure generated by the pushing element 31 for keeping stiffly the two supports 6, 7 in position by means of the rod 23 and of the bracket 26, and also the fourth bearings 38 are loaded accordingly. In this case the actuating element 41, represented by the group made up of the lower stem 41*b* and of the upper stem 41*a* of the pneumatic piston 43, is in rest position. In order to move the first 6 and the second 7 support in the first threading position, for instance the one in which the two supports 6, 7 are rotated to the left as is shown on FIG. 3, the activation element 33 moves the bolt 21 to the lifted position thus releasing the bracket 26 from the second support 7. Then the actuating element 41 is moved from the rest position to the pushing position; in this specific case, the lower stem 41*b* gets downwards taking with it the second support 7. The return from the first threading position to the operating position is obtained by actuating the piston 43 so that the lower stem 41*b* gets upwards taking with it the second support 7.

Also for bringing the two supports 6, 7 from the operating position to the second threading position, for instance rotated to the left as is shown on FIG. 4, the bolt 21 is led by means of the activation element 33 from the lowered position to the lifted position so as to release the bracket 26 from the second support 7. The second threading position is obtained by letting the whole body of the pneumatic piston 43 and, therefore, the second support 7 get upward. The return from the second threading position to the operating position is achieved by actuating the piston 43 so as to empty the chamber above the upper stem 41*a* and to fill the area below.

Obviously, it can be switched directly from the first to the second threading position or conversely, without stopping in the operating position.

It should be pointed out that, when the two supports 6, 7 are in operating position but the bolt 21 is in lifted position, said supports 6, 7 are still supported and kept in position by the movement means 40 in rest position.

The inventive idea of the present invention also includes a warp linear knitting machine characterized in that it comprises at least one of the devices 1 for threading thread-guides 5 described above. In particular, the machine 10 comprises as a rule two of these devices 1, one placed on a first end portion 3 of the thread-guide 5 bars 2 and one placed on a second end portion 4 thereof, opposite the first one 3, so as to prevent torsions of said bars 2.

Advantageously, the machine 10 further comprises adjustment and control means or adjuster and controller designed to control the function thereof, which are of known type and will therefore not be described or disclosed in detail. In particular, said means or adjuster and controller control both the blocking means or blocker 20, by activating selectively the activation element 33 of the bolt 21, and the movement means or mover 40, by guiding for instance the movement of the pneumatic piston 43. As a consequence, the release, rotation and coupling recovery procedure is controlled and fully automated. Thanks to the adjustment and control means or adjuster and controller, the first 6 and the second 7 support are kept in the various positions, operating position and first and second threading position, in a stable and controlled manner.

Preferably, therefore, thanks to the adjustment and control means the release and positioning cycle of the two supports 6, 7 in the two threading positions is obtained by simply pressing dedicated pushbuttons, which are associated to the supporting structure 11 of the machine 10.

The invention thus conceived can undergo several changes and variants, all of which fall within the framework of the inventive idea.

In practice, any material or size can be used, depending on the various needs.

Moreover, all details can be replaced by technically equivalent elements.

The invention achieves important advantages.

Firstly, the device for improving the threading of the thread-guides shown above makes said thread-guides accessible and enables an easy and practical threading both during the setup of the machine before starting a new knitting process and in case of maintenance operations during knitting, due for instance to the breaking of one or more threads. As a matter of fact, the rotation of the two supports with respect to the supporting structure so as to bring the thread-guides outside the knitting area and improve threading can be carried out also during the knitting process without damaging the knitted items being manufactured and creating unbalances in the machine.

A further advantages consists in that operators carrying out threading can work safely and in comfortable and ergonomically correct conditions. This is due to the fact that the devices according to the invention make the thread-guides well visible and accessible before the operator, without the need for the latter to bend or work blindly.

Moreover, a knitting machine provided with the devices for improving the threading of thread-guides is extremely accurate, enables to obtain knitted items of very high quality and can be easily installed in a manufacturing plant since its structure is slim, compact, little bulky and practical.

The invention claimed is:

1. A device (1) for improving the threading of thread-guides (5) for warp linear knitting machines (10), comprising:

at least a first support (6) that is coupled to a supporting structure (11) of a warp linear knitting machine (10), a plurality of thread-guides (5) designed to guide threads while knitting a knitted item, and a plurality of thread-guide (5) bars (2) operatively coupled to said first support (6), said plurality of thread-guides (5) being coupled to said plurality of thread-guide (5) bars (2);

said first support (6) being movable with respect to said supporting structure (11) between an operating position, in which said thread-guides (5) are active for the formation of said knitting item, and at least one threading position, angularly rotated with respect to said operating position, in which the thread-guides (5) are led outside the knitting area and the threading of said thread-guides (5) takes place.

2. The device (1) according to claim 1, characterized in that said first support (6) is movable between said operating position and two of said threading positions, a first one of said two threading positions being rotated with respect to said operating position clockwise and a second one of said two threading positions being rotated counterclockwise.

3. The device (1) according to claim 1, characterized in that it further comprises an oscillating shaft (12) having a main axis (13), said first support (6) being movable between said operating position and said at least one threading position by rotating around said main axis (13) of said oscillating shaft (12).

4. The device (1) according to claim 3, characterized in that it further comprises a second support (7) operatively placed between said supporting structure (11) and said first support (6) and moving between said operating position and said at least one threading position integrally with said first support (6).

5. The device (1) according to claim 4, characterized in that in said operating position said first support (6) is movable with respect to said second support (7) with oscillating motion around said main axis (13) of said oscillating shaft (12) so as to move said thread-guides (5) by means of said thread-guide (5) bars (2) transversally with respect to the hook of needles (16) for feeding correctly the threads onto said needles (16).

6. The device according to claim 5, characterized in that said oscillating motion of said first support (6) with respect to said second support (7) around said main axis (13) of said oscillating shaft (12) is less broad than the movement of said first (6) and said second (7) support with respect to said supporting structure (11) around said main axis (13) of said oscillating shaft (12) for the passage between the operating position and the threading positions.

7. The device (1) according to claim 4, characterized in that it further comprises a blocker (20) designed to block said first (6) and said second (7) support in rotation with respect to said supporting structure (11) so as to let them stay in operating position, and to release said first (6) and said second (7) support in rotation with respect to said supporting structure (11) so as to enable the movement thereof from said operating position to said at least one threading position.

8. The device according to claim 7, characterized in that said blocker (20) comprises a bolt (21) that is movable with respect to said supporting structure (11) according to a basically vertical direction perpendicular to the main axis (13) of said oscillating shaft (12) between a lowered position and a lifted position, and an engagement element (22) operatively coupled to said bolt (21) so as to move longitudinally between an active position, when said bolt (21) is in said lowered position, in which said engagement element (22) acts operatively upon said second support (7) so as to block it in rotation with respect to the supporting structure (11), and a passive position, when said bolt (21) is in lifted position, in which said engagement element (22) is led away from said second support (7) so as to enable the rotation thereof for the passage from the operating position to the threading positions.

9. The device according to claim 8, characterized in that said engagement element (22) comprises a rod (23) developing according to a longitudinal direction basically perpendicular to the direction of movement of the bolt (21), and a bracket (26) fitted onto a first end (24) of said rod (23), designed, when said engagement element (22) is in active position, to exert a pushing action onto said second support (7) that is basically perpendicular to said second support (7), so as to prevent the rotation thereof with respect to the supporting structure (11).

10. The device according to claim 9, characterized in that said bolt (21) has a cam profile (27), said rod (23) being operatively coupled to said cam profile (27) on a second end (25) thereof, and in that said blocker (20) further comprises a pushing element (31) acting upon said second end (25) of said rod (23) so as to push it against said cam profile (27) so as to move said rod (23) and said bracket (26) between the passive and the active position.

11. The device according to claim 10, characterized in that said blocker (20) comprises a first bearing (32) moving longitudinally according to the direction of movement of the rod (23) and firmly fitted onto said rod (23) on said second end (25), said pushing element (31) acting upon said rod (23) by means of said first bearing (32) and said rod (23) being operatively coupled to said cam profile (27) by means of said first bearing (32).

12. The device (1) according to claim 11, characterized in that said cam profile (27) is tapered down at least on one side, having at least a first portion (28) and a second portion (29), which is longitudinally concave with respect to said first portion (28), and in that, when said bolt (21) is in said lowered position, said first bearing (32) is in contact with said first portion (28) of said cam profile (27) so that the rod (23) in active position is pulled back longitudinally for blocking the rotation of said second support (7) with respect to the supporting structure (11), and when said bolt (21) is in said lifted position, said first bearing (32) is in contact with said second portion (29) of said cam profile (27) so that the rod (23) in passive position is pushed forward longitudinally for releasing the second support (7) from rotation with respect to the supporting structure (11).

13. The device (1) according to claim 8, characterized in that said blocker (20) further comprises an activation element (33) designed to move said bolt (21) between said lifted and said lowered position.

14. The device (1) according to claim 8, characterized in that said blocker (20) further comprises at least one second bearing (34) designed to guide said bolt (21) in its movement from said lifted and said lowered position and to cooperate with said pushing element (31) and with said first bearing (32) for stiffly keeping said rod (23) and said bracket (26) in active position.

15. The device (1) according to claim 8, characterized in that said bolt (21) in said lowered position engages with said second support (7) on an upper portion (7*a*) thereof.

16. The device (1) according to claim 15, characterized in that said blocker (20) further comprises a first guide (37*a*) coupled to said upper portion (7*a*) of said second support (7), and a second guide (37*b*) coupled to the supporting structure (11) of the machine (10) on the bolt (21), said first (37*a*) and said second (37*b*) guides being designed to improve the sliding of the bolt (21) and to stiffly fit the bolt (21) onto the second support (7).

17. The device (1) according to claim 1, characterized in that it further comprises a mover (40) operatively coupled to said first (6) or to said second (7) support and designed to move said first (6) and said second (7) support between said operating position and said at least one threading position.

18. The device (1) according to claim 17, characterized in that said mover (40) comprises an actuating element (41) coupled to said second support (7) and designed to impart to said first (6) and said second (7) support a pushing and for pulling action for moving them between said operating position and said at least on threading position.

19. The device (1) according to claim 18, characterized in that said actuating element (41) has a basically vertical development perpendicular to the main axis (13) of the oscillating shaft (12) and it is coupled by means of a lower end (42) thereof to a lateral portion (8) of said second support (7), at least said lower end (42) of said actuating element (41) being movable and articulated, when said bolt (21) is in lifted position, according to a vertical direction pointing downwards between a rest position in which the first support (6) is in operating position, and a pushing position for pushing said first (6) and said second (7) support between said operating position and a first threading position or between a second threading position and said operating position, and according to a vertical direction pointing upwards between said rest position and a pulling position for pulling said first (6) and said second (7) support between said operating position and said second threading position or between said first threading position and said operating position.

20. The device (1) according to claim 18, characterized in that said mover (40) comprises a pneumatic piston (43), said actuating element (41) being a stem of said pneumatic piston (43).

21. The device (1) according to claim 18, characterized in that said mover (40) comprises a screw motor, said actuating element (41) being a screw of said motor.

22. The device (1) according to claim 4, characterized in that said supporting structure (11) comprises a guide (14) having a basically curved shape, and in that said second support (7) comprises at least one third bearing (15) designed to slide in said guide (14) for guiding the movement of said second support (7) between said operating position and said at least one threading position.

23. A warp linear knitting machine (10) characterized in that it comprises at least one of said devices (1) for threading thread-guides (5) according to claim 1.

24. The machine (10) according to claim 23, characterized in that it comprises at least two of said devices (1), one of said devices (1) being positioned on a first end portion (3) of said plurality of thread-guide (5) bars (2), and one being positioned on a second end portion (4), opposite said first end portion (3), so as to prevent torsions of said plurality of thread-guide (5) bars (2).

25. The machine (10) according to claim 24, characterized in that it comprises an adjuster and controller designed to control the function thereof.

26. The machine (10) according to claim 25, characterized in that said activation element (33) is selectively activated by said adjuster and controller.

27. The machine (10) according to claim 25, characterized in that said mover (40) is selectively activated by said adjuster and controller.

* * * * *